United States Patent [19]

Litchfield et al.

[11] 4,212,503

[45] Jul. 15, 1980

[54] DRAWERS AND DRAWER RUNNERS

[75] Inventors: Leon G. Litchfield; Terence Hardy, both of Nether Heage, England

[73] Assignee: L. B. (Plastics) Limited, Derby, England

[21] Appl. No.: 899,559

[22] Filed: Apr. 24, 1978

[30] Foreign Application Priority Data

Nov. 26, 1977 [GB] United Kingdom ..... 49329/77

[51] Int. Cl.[2] ..... F16C 21/00

[52] U.S. Cl. ..... 308/3.6; 312/348

[58] Field of Search ..... 308/3.6, 3.8; 312/348, 312/346, 330 R

[56] References Cited

U.S. PATENT DOCUMENTS

| | | | |
|---|---|---|---|
| 958,203 | 5/1910 | Weiss | 312/348 X |
| 2,337,079 | 12/1943 | Zalkind | 312/348 X |
| 3,722,975 | 3/1973 | Taylor | 312/348 |
| 4,033,639 | 7/1977 | Benoit et al. | 308/3.6 |

*Primary Examiner*—Douglas C. Butler

*Attorney, Agent, or Firm*—Marshall & Yeasting

[57] ABSTRACT

A drawer runner comprising an elongated member having a longitudinal channel formed in the face thereof which is adjacent to the drawer in use, a stop member projecting into the channel at a position spaced inwardly from the end of the runner which is forwardmost in use and having a rearwardly directed face, the stop member being arranged to co-operate with a projection on a drawer to prevent complete withdrawal of the drawer from its cabinet or other housing, a portion of the upper surface of the runner being cut away in the region of the stop member whereby to permit upward tilting of the drawer about the front end of the runner to disengage the projection from the stop member and enable the drawer to be withdrawn from the housing.

12 Claims, 4 Drawing Figures

DRAWERS AND DRAWER RUNNERS

The invention relates to drawers and to drawer runners.

It is becoming increasingly important to provide stop means for preventing complete withdrawal of drawers from their cabinets or other housings and it is an object of the present invention to provide a drawer runner arrangement incorporating stop means of this kind while at the same time enabling the drawer to be removed completely from the cabinet or other housing when required.

The invention provides a drawer runner comprising an elongated member having a longitudinal channel formed in the face thereof which is adjacent to the drawer in use, a stop member projecting into said channel at a position spaced inwardly from the end of the runner which is forwardmost in use and having a rearwardly directed face, the stop member being arranged to co-operate with a projection on a drawer to prevent complete withdrawal of the drawer from its cabinet or other housing, a portion of the upper surface of said runner being cut away in the region of said stop member whereby to permit upward tilting of the drawer about the front end of the runner to disengage the projection from the stop member and enable the drawer to be withdrawn from the housing.

Preferably, said stop member projects downwardly from the upper side wall of said channel and the lower side wall of the channel is cut away in the region beneath the stop.

Preferably also, the upper and lower surfaces of the runner are cut away at the longitudinal edges thereof which are adjacent to the casing or housing in use, whereby longitudinal tracks or recesses are provided enabling use of the runner with a drawer having a runner groove provided with upwardly and downwardly projecting longitudinal lips which slidably engage in the recesses in the runner and retain the drawer against lateral displacement.

The invention also provides a drawer assembly comprising a pair of runners as aforesaid and a drawer having runner grooves in its opposite side walls adapted for sliding location on the respective runners, and a projection at or adjacent at least one rear corner of the drawer for engagement with the stop member on the associated runner after a predetermined amount of movement of the drawer relative to the runners.

An embodiment of the invention will now be described, by way of example only, with reference to the accompanying drawings, in which.

Figure 1:
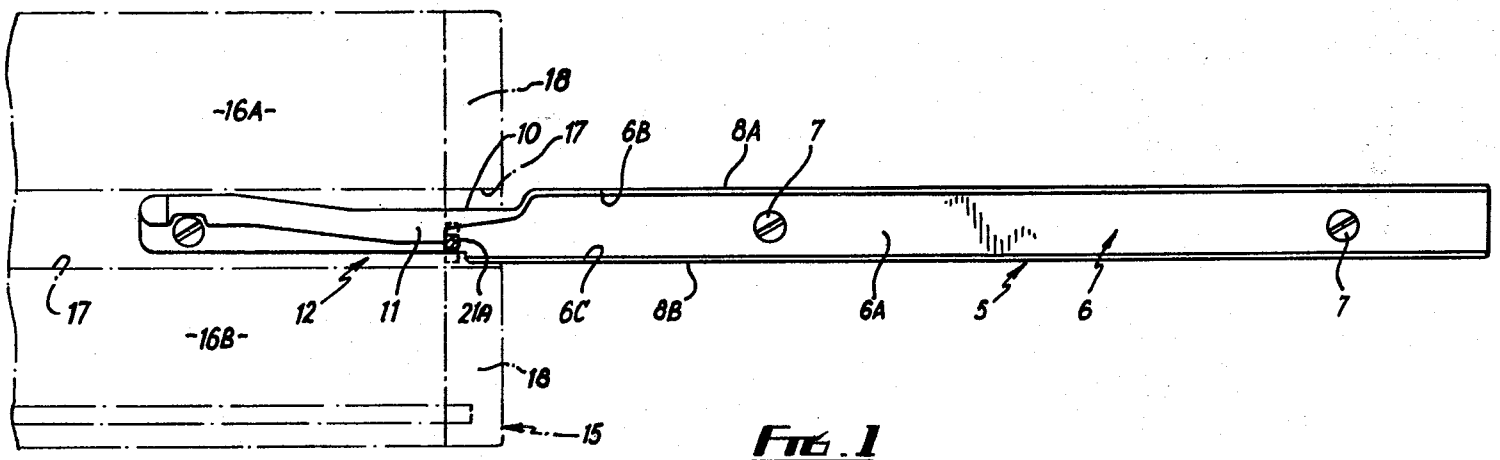
FIG. 1 is a side view of a runner according to the invention showing a drawer in its fully opened position.

Referring to the drawings, the runner is indicated at 5 and comprises an elongated member formed of plastics material. In use, a pair of such runners are mounted at opposite sides of a cabinet or other housing in horizontal positions with one end of each runner directed towards the front of the cabinet and the other towards the rear so that the runners project from the opposite walls of the cabinet towards one another and may be engaged by runner recesses formed in opposite sides of a drawer to be slidably mounted in the cabinet. The runner recesses have upper walls which are slidably supported on the upper surfaces of the runners, the inwardly directed faces of the runners being directed towards the bases of the respective runner recesses, all of which is well known in the art. A channel 6 is formed in the inwardly directed face and the base 6A of the channel is provided with through holes to enable the runner to be secured in position in a cabinet or other housing such as that referred to above, by means of screws 7. The upper and lower surfaces 8A, 8B of the runner are cut away at the longitudinal edges thereof which are directed away from the drawer in use to form longitudinal recesses 9A, 9B (FIGS. 3 and 4) the purpose of which will be explained hereafter.

At the forward end region of the runner, the upper and lower surfaces are cut away to form a section of reduced height and to produce a recess 10 extending across the upper surface of the runner. The upper side wall 6B of the channel 6 extends along the edge of the recess 10 and is thickened to define a downwardly extending and rearwardly facing stop member 11. The stop member thus projects into the channel 6 and is arranged to co-operate with a projection on a drawer slidably mounted on the runner. The lower side wall 6C of the channel 6 is cut away in the region 12 beneath the stop 11. The upper surface of the runner slopes upwardly from the recess 10 towards the front end of the runner.

Figure 2:
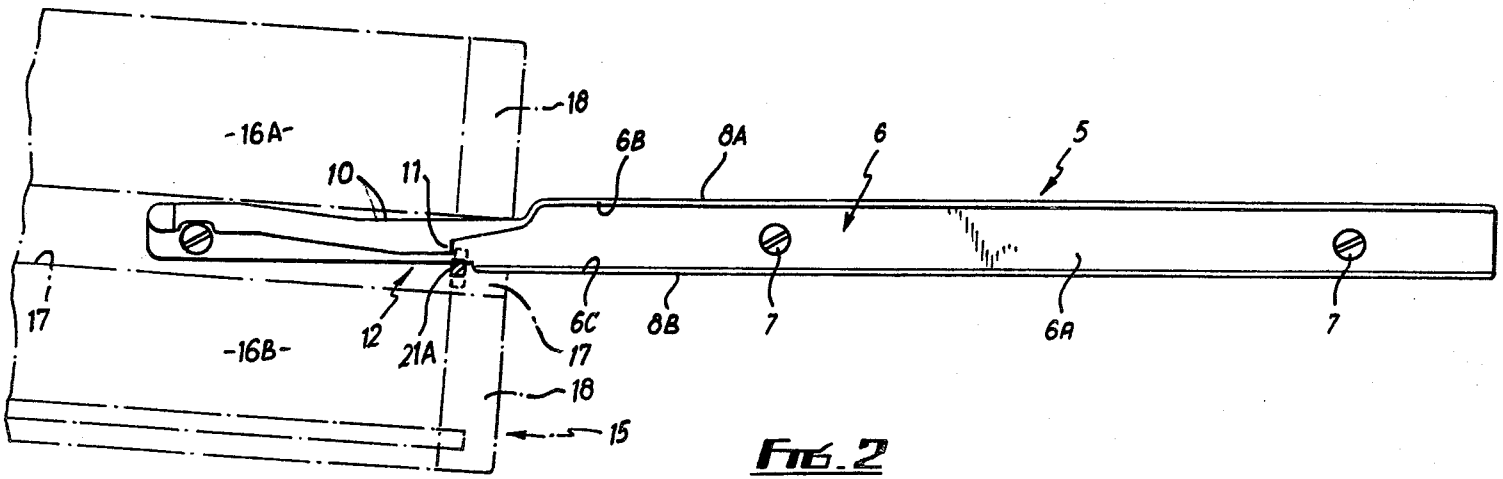
FIG. 2 is a similar view showing the drawer tilted for removal.

The drawings show the rear section of a drawer 15 slidably mounted on a pair of runners of the kind shown in FIGS. 1 and 2. The drawer is constructed from side and back wall panels of extruded plastics construction having upper and lower hollow sections 16A, 16B interconnected by a web 20 and which define between them a longitudinal runner groove or channel 17 recessed into the panel. The channel 17 in the side wall panels are adpated to be slidably engaged with the runners 5 mounted at the respective opposite sides of the cabinet. The side and rear walls of the drawer are interconnected by corner pieces indicated at 18. Examples of the above type of drawer construction are shown in U.S. Pat. Nos. 3,901,572 and 4,042,288 issued Aug. 26, 1875 and Aug. 16, 1977, respectively, both to Leon G. Litchfield. A stop member 19 is fitted to the drawer in the region of one or both of the rear corner pieces. For this purpose a portion is cut out of one or both ends of the web 20 which interconnects the upper and lower hollow sections 16A, 16B of the back wall of the drawer to provide an opening or notch (not shown) in which the stop member 19 is slidably mounted. The stop member is provided with a projection which extends across the channel 17 in the adjacent side wall of the drawer into the path of the stop member 11 on the drawer runner 5.

Figure 3:
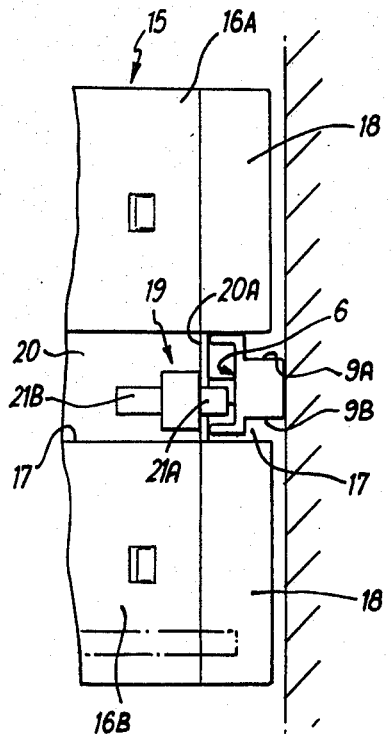
FIG. 3 is a fragmentary rear view of one form of drawer mounted on a runner of the kind shown in FIGS. 1 and 2.
Figure 4:
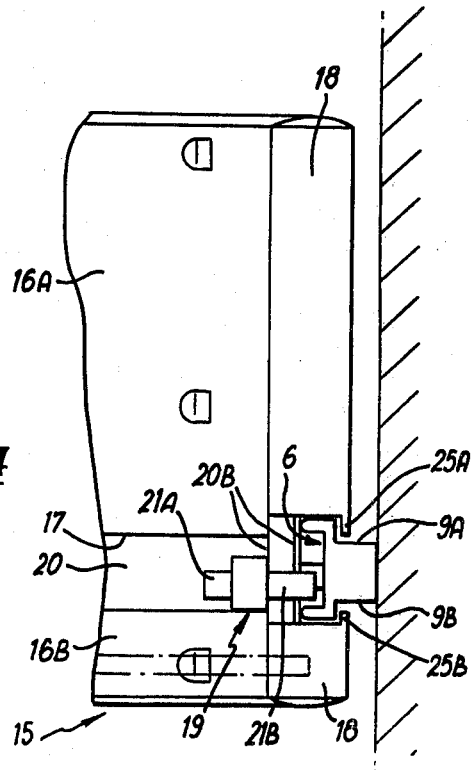
FIG. 4 is a view similar to FIG. 3 showing an alternative form of drawer.

In the arrangement shown in FIGS. 3 and 4 the stop member 19 is provided with alternatively useable projections 21A and 21B which are of different lengths. The short projection 21A is intended to be used with a drawer of the kind shown in FIG. 3 in which the upper and lower hollow sections of the wall panels are interconnected by a single web 20A. The longer projection 21B is intended to be used with a drawer of the kind shown in FIG. 4 in which the upper and lower hollow sections of the wall panels are interconnected by a double web 20B. The stop member is fitted in one or other position depending on the nature of the drawer concerned so that the projection 21A or 21B projects into the channel 17 to the same extent in either case. Alternatively useable separate stop members could of course be provided in place of the reversible stop member 19 if desired.

The longitudinal recesses 9A, 9B referred to previously are provided to enable use of the runner with a drawer of the kind shown in FIG. 4 in which the runner recesses formed in the opposite sides of the drawer have longitudinally extending upwardly and downwardly directed projections 25A, 25B extending longitudinally of the upper and lower edges of the runner recesses 17. Drawers constructed in this way provide a degree of control over lateral movement of the drawer and when used in association with the runners described, the projections 25A, 25B extend into the recesses 9A, 9B in the runner which is thus retained within the runner grooves. This also reduces the area of surface contact between the drawer and the runner compared with runners not provided with recesses such as 9A, 9B, thereby reducing friction and facilitating sliding movement. In addition, the area of support for the drawer is at the innermost region of the runner groove in the drawer side.

The arrangement is such that when the drawer is drawn out of its cabinet or housing to a predetermined extent the projections 21A or 21B contact the stop members 11 on the drawer runners and prevent further withdrawal of the drawer (FIG. 1). If it is desired to remove the drawer completely from the cabinet, the front of the drawer is lifted, as shown in FIG. 2, causing the drawer to pivot about fulcrums formed by the upper surfaces of the front ends of the drawer runners, the rear corners of the drawer dropping into the recesses 10 in the upper surfaces of the runners so that the projections 21A or 21B drop clear of the stop members 11 and the drawer can then be drawn forwardly out of the cabinet. In order to re-insert the drawer the operation is reversed and once the drawer is correctly in position in the cabinet, normal opening will be limited by abutment of the projections on the drawer and the stop members on the runners as before.

It should be noted that due to the position of the stop member on the runner some distance rearwardly from the forward end of the runner, the co-operating projection on the drawer itself can be provided closely adjacent to the rear corner. This is particularly advantageous in that it is relatively simple to provide some form of projection at this region, particularly where the drawer is formed from interfitting wall panels and corner connecting pieces. A further advantage resides in the fact that during tilting movement the projection 21A or 21B on the drawer is lowered relative to the stop member 11 on the runner and the upper side wall 6B of the runner channel 6 prevents movement of the projection in the opposite direction. Thus, when the drawer is heavily loaded and in its outermost position the weight of the drawer tends to move the projection on the drawer into engagement with the stop member on the runner and acts as a safety feature. A further advantage arises from the fact that the channel in the runner is unobstructed in the region behind the stop member 11 so that the projection on the drawer cannot strike any obstacle on the runner when the drawer is closed.

By virtue of the arrangement described there is provided a drawer runner incorporating integral stop means to prevent complete withdrawal of a drawer from a cabinet or the like, which is so constructed that the stop member on the drawer may be located at a rear corner where fitting of such a member can be readily effected and which ensures that an open drawer which is heavily loaded cannot inadvertently slide out of the cabinet. In addition the runner and stop member may be integrally moulded from synthetic plastics material so that no separate parts which might become detached and lost are required.

Various modifications may be made without departing from the invention. For example the longitudinal recesses 9A, 9B in the runner may be omitted although they are preferably provided to enable a single runner to be used with the different types of drawer described. The position and shape of th stop member on the runner and of the cut-away portion 10 of the runner may also be altered to suit different requirements. In addition, various different forms of projection may be provided on the drawer and may be fitted to the drawer wall panel members as described or trapped between the panel members and the corner connectors. Where the corner connectors are provided with a linking member in the region of the runner groove 17, as in a drawer of the kind shown in FIG. 4, suitable projections could be formed on the corner connectors themselves.

We claim:

1. A drawer runner adapted to be mounted on a support structure in a horizontal position with one end of the runner directed towards the front of the structure and so that a pair of such runners mounted at opposite sides of the support structure may slidably support a drawer on upper surfaces thereof for movement relative to the support structure, the drawer runner comprising an elongated member having a longitudinal channel formed in a face thereof which is directed inwardly of the support structure in use, a stop member projecting into said channel at a position spaced inwardly from said front of the runner and having a rearwardly directed face, the stop member being arranged to co-operate with a projection on the drawer to prevent complete withdrawal of the drawer from the support structure, a portion of the upper surface of said runner being cut away in the region of said stop member whereby to permit upward tilting of the drawer about the front end of the runner to disengage the projection from the stop member and enable the drawer to be disengaged from the support structure.

2. A drawer runner according to claim 1 wherein said stop member projects downwardly from an upper side wall of said channel and the lower side wall of the channel is cut away in a region beneath the stop member.

3. A drawer runner according to claim 2 or 1 wherein said upper surface of the runner slopes upwardly from said recess towards the front end of the runner.

4. A drawer runner according to claim 2 or 1 wherein the upper and lower surfaces of the runner are cut away at the longitudinal edges thereof which are adjacent to the support structure in use to provide longitudinal recesses.

5. A drawer runner according to claim 2 or 1 wherein said stop member is molded integrally with the runner from plastics material.

6. A drawer assembly comprising a pair of runners according to claim 1 and a drawer having runer grooves in its opposite side walls adapted for sliding location on the respective runners, and a projection adjacent each rear corner of the drawer for engagement with the stop members on the associated runners after a predetermined amount of movement of the drawer relative to the runners.

7. A drawer assembly according to claim 6 wherein said projections are carried by a stop members detachably mounted on the drawer, the stop members having alternatively useable projections at their opposite ends for use with drawers of different construction.

8. A drawer assembly according to claim 6 wherein the back and sides of the drawer are formed from extruded plastics wall panels each having upper and lower hollow sections interconnected by a web defining a longitudinal channel, the channels in the side wall panels constituting said runner grooves and the projections being mounted on said web.

9. A drawer assembly according to claim 8 wherein the projections slidably engaged with a notches formed in said web.

10. A drawer assembly according to claim 8 or 9 wherein said side and back walls are interconnected by corner pieces, each projection being trapped between the associated corner piece and the back or side wall panel connected thereto.

11. A drawer assembly according to claim 8 or 9 wherein said side and back wall panels are interconnected by corner pieces, each projection being carried by the associated corner piece.

12. A drawer assembly according to claim 6 or 7 wherein the upper and lower surfaces of the runner are cut away at the longitudinal edges thereof which are adjacent to the support structure in use to provide longitudinal recesses and said runner grooves have upwardly and downwardly directed longitudinal projections at the longitudinal edges thereof which extend in use into said longitudinal recesses in the associated runners.

* * * * *